US009204768B2

(12) United States Patent
Green et al.

(10) Patent No.: US 9,204,768 B2
(45) Date of Patent: Dec. 8, 2015

(54) TRI-SEAT FOR TOILET

(76) Inventors: Fannie Green, Boynton Beach, FL (US); Eileen Green-Hatcher, Boynton Beach, FL (US)

( * ) Notice: Subject to any disclaimer, the term of this patent is extended or adjusted under 35 U.S.C. 154(b) by 282 days.

(21) Appl. No.: 13/571,025

(22) Filed: Aug. 9, 2012

(65) Prior Publication Data

US 2013/0074253 A1 Mar. 28, 2013

Related U.S. Application Data

(60) Provisional application No. 61/539,281, filed on Sep. 26, 2011.

(51) Int. Cl.
*A47K 13/00* (2006.01)

(52) U.S. Cl.
CPC ..... *A47K 13/005* (2013.01)

(58) Field of Classification Search
CPC ..... A47K 13/06; A47K 13/005
USPC ..... 4/235, 237, 238, 239
See application file for complete search history.

(56) References Cited

U.S. PATENT DOCUMENTS

| | | | | | |
|---|---|---|---|---|---|
| 54,480 | A * | 5/1866 | Alexander | ..... | 4/235 |
| 2,692,992 | A | 11/1954 | Thknmes | | |
| 4,461,046 | A | 7/1984 | Adams | | |
| 4,516,279 | A | 5/1985 | Block | | |
| 5,182,818 | A * | 2/1993 | Nawoj | ..... | 4/235 |
| 5,448,781 | A * | 9/1995 | Miller | ..... | 4/235 |
| 6,449,780 | B1 | 9/2002 | Merry | | |
| 6,952,842 | B2 * | 10/2005 | Courtney | ..... | 4/235 |
| 2006/0085899 | A1 * | 4/2006 | Coles et al. | ..... | 4/237 |

* cited by examiner

*Primary Examiner* — Tuan N Nguyen
*Assistant Examiner* — William R Klotz
(74) *Attorney, Agent, or Firm* — Daniel Baldwin; Global Intellectual Property Agency LLC.

(57) ABSTRACT

Disclosed is a toilet seat comprising a primary seat, a first auxiliary seat, and a second auxiliary seat. The primary seat can be used by individuals of average size in a conventional manner, while the first auxiliary seat can be used by smaller individuals. The second auxiliary seat can be used by individuals of larger size. Each seat can be independently raised and lowered as needed. The primary seat attaches below the first and second auxiliary seat, providing a support surface thereto. The device can be installed on a conventional toilet, requires no maintenance, and provides a seat that can accommodate a variety of different sized individuals.

15 Claims, 2 Drawing Sheets

TRI-SEAT FOR TOILET

CROSS REFERENCE TO RELATED APPLICATION

This application claims the benefit of U.S. Provisional Application No. 61/539,281 filed on Sep. 26, 2011, entitled "TriSeat." The patent application identified above is incorporated here by reference in its entirety to provide continuity of disclosure.

BACKGROUND OF THE INVENTION

Field of the Invention

The present invention relates to hingeable toilet seats. More specifically, the present invention relates to a toilet seat that can be used by individuals of varying size.

A toilet seat is a hinged apparatus that is attached to a toilet bowl, and generally consists of a sitting area and lid. The seat is attached to a conventional toilet with a pair of seat bolts that fit through the opening in the toilet base, and is then threaded into position. The sitting area provides a location for a user to sit while using the toilet. The hinge enables the device to be lifted for male urination or for cleaning.

Conventional toilets and toilet seats are available in two different configurations. Round toilets are completely circular, and are typically found on older style toilets. This design results in a smaller toilet, which is useful for installation in bathrooms with limited space. Elongated toilets and seats, on the other hand, have a longer, oval shape, with a front that is narrower than the rest of the bowl. Elongated bowls have a greater capacity, thereby resulting in less chance of clogs or overflowing. Both round and elongated toilets have the same width, and vary in length by approximately two inches. Regardless of whether the toilet comprises a round or elongated toilet bowl, the seat installed thereon is designed for use by an average adult. While this may be ideal for a majority of users, several groups of people, particularly those who are below or above average size, have difficulty properly fitting on a conventional toilet seat.

Children typically begin potty training between eighteen months and three years of age. At this time they are considerably smaller than the average sized adult, which makes it difficult for children to use a conventional toilet seat. Children must balance with their arms in order to prevent themselves from falling in. In such situations, a child may be concentrating more on balance than on learning to use the toilet. An alternative is to use a child seat that can be secured inside the conventional toilet seat opening. These devices, however, can be easily misplaced, and may be difficult for children to install on their own.

Another group that finds difficulty fitting on a conventionally sized toilet seat is larger adults who may not be able to support the majority of their weight on the seat. This makes balancing while on the seat difficult, and creates a challenge for the user to comfortably use the toilet. User's can install an oversized toilet seat, however, these devices are difficult to use for those of below average size. In such situations, a large adult may have to install the device on one toilet in his or her home, and use that toilet exclusively, while the smaller members of the house are then forced to use a different toilet.

The present invention can enable individuals of all ages and sizes to use the same toilet seat without any discomfort. The device comprises a toilet seat with three different-sized sitting areas. A first seat is sized for smaller individuals, while a second seat is designed to fit a standard sized toilet. On the outside of the standard sized seat is a larger seat that can be used for large adults. The additional seats can be attached with a secondary hinge in the back of the device, while each individual seat can be raised and lowered in a manner similar to a conventional toilet seat. In this way, the device can provide a comfortable and safe sitting environment for users of varying size.

DESCRIPTION OF THE PRIOR ART

Presently, several inventions have been disclosed in the art that provide a toilet seat designed for users of varying size. Some of these devices include a smaller toilet seat with a standard sized toilet seat attached at a hinge, whereby the smaller toilet seat can be raised and lowered independently of the standard seat. A smaller user can put the smaller seat down so that it rests on top of the standard sized toilet seat, which prevents the user from feeling as if he or she is going to fall into the toilet bowl. A standard size user can place the smaller seat in the "up" position, and use the standard seat in a conventional manner. Other devices describe removable seats for small users that can be placed inside the opening of the standard sized seat. The seat can be stored in an area away near the toilet seat, placed in position when needed, and returned to its storage location when not in use. While these seats are useful for those who are below average size, such as children, and for average sized adults, they are not adapted for use by larger individuals.

Several devices have been disclosed in the art that provide a toilet seat with sitting areas for both average sized adults and children. Adams, U.S. Pat. No. 4,461,046 discloses a toilet seat assembly that permits the selective use of an appropriate sized opening for use by an individual, such as an adult or a child. The seating component includes an extended lip portion designed to protrude into the lower opening to prevent lateral movement of the seats when in-use, thereby affording greater stability to the user. This device, however, is adapted for use by smaller users, such as children, as well as average sized adults. The device does not include a large sitting area that extends outside of the standard sized toilet seat.

Similarly, Merry, U.S. Pat. No. 6,449,780 discloses a combined adult and children's toilet seat assembly having a seat mounting structure, a toilet seat lid and an adult toilet seat. The device includes a seat mounting structure, a toilet seat lid, and a children's toilet seat pivotally mounted about a second axis forwardly of the first axis. This allows for movement of the children's toilet seat between a near horizontal position over the adult toilet seat and a near vertical position tilted rearwardly into the seat lid. The children's toilet seat is releasably mounted to the adult toilet seat for pivotal movement by at least one, and preferably two, resiliently expandable gripper structures. Moreover, the adult toilet seat advantageously includes a plurality of upwardly extending, laterally-spaced flanges to which the child's seat is mounted and which also provides a barrier-resisting liquid migration toward the rear of the assembly. While this device provides a seat for both average sized adults and children, it does not include an extended seat for use by a larger adult.

In addition to the '046 and '780 patents, Miller, U.S. Pat. No. 5,448,781 discloses a toilet seat assembly comprising a standard sized toilet seat and a smaller toilet seat for use by a smaller individual, which is supported by the standard sized seat when in a lowered position. The device further includes a cover for the seats, a hinge block and retractable hinge pins for connecting the seats. The hinge allows for independent movement of both seats. This device, however, is only designed for use by adults of average size, as well as smaller individuals or children. The device does not provide a means of supporting a larger adult.

Thknmes, U.S. Pat. No. 2,692,992 discloses an auxiliary seat for an infant that is connected to a seat and cover of conventional size. The seat is nested within the cover in a manner whereby it does not interfere with the normal function of the cover, and is connected to the cover in a manner so that it can be moved to an operative position for use with the standard toilet seat. This device, however, differs in design from that of the present invention. The '992 patent creates a frame for attachment of a child seat, whereas the present invention discloses multiple seats that can be raised and lowered in a conventional manner.

Other inventions in the prior art disclose toilet seats for children that can be removably attached to a conventional toilet seat. Block, U.S. Pat. No. 4,516,279 discloses a child's toilet trainer seat that is adaptable for use with a conventional toilet seat that lies on top of the conventional toilet seat and which, in a storage position, rests against the lid of the toilet. This device, however, rests on top of a conventional toilet seat, does not attach to the seat, and does not include an oversized seat.

The devices disclosed in the prior art utilize a seat for both average sized adults, as well as smaller children. The primary function of such devices is to allow a child who is otherwise too small to fit on a conventional toilet seat to rest comfortably thereon while using the toilet. The present invention, however, provides a toilet seat that can be used by average sized adults, smaller children, and larger adults who find it difficult to position themselves on a conventional toilet seat. The three seats can be operated independent of each other, thereby enabling a user to quickly select the appropriate sized seat for use.

In light of the prior art and the disclosed elements of the present invention, it is submitted that the present invention substantially diverges in design elements from the prior art. Consequently, it is clear that that present invention is not described by the art and that a need exists for an improved debris receiving receptacle that attaches to the edge of a work surface. In this regard, the instant invention substantially fulfills these needs.

SUMMARY OF THE INVENTION

In view of the foregoing disadvantages inherent in the known types of toilet seats now present in the prior art, the present invention provides a new toilet seat wherein the same can be utilized for providing convenience for the user when being used by individuals of varying size.

It is therefore an object of the present invention to provide a new and improved toilet seat device that has all of the advantages of the prior art and none of the disadvantages.

Another object of the present invention is to provide a toilet seat wherein the sitting area may be varied in size in order to accommodate users of varying size, such as small children, average sized adults, and larger individuals.

Another object of the present invention is to provide a toilet seat that fits on a standard sized toilet bowl.

Yet another object of the present invention is to provide a toilet seat comprising a first seat sized for smaller individuals. The seat is adapted to fit within the opening of a standard sized toilet.

Another object of the present invention is to provide a toilet seat with a larger seat that can be attached to the outside of a conventional toilet seat.

A further object of the present invention is to provide a toilet seat wherein the additional seats can be attached with a secondary hinge in the back of the seat.

Another object of the present invention is to provide a toilet seat wherein each individual seat can be raised and lowered in a manner similar to a conventional toilet seat.

A final object of the present invention is to provide a toilet seat that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
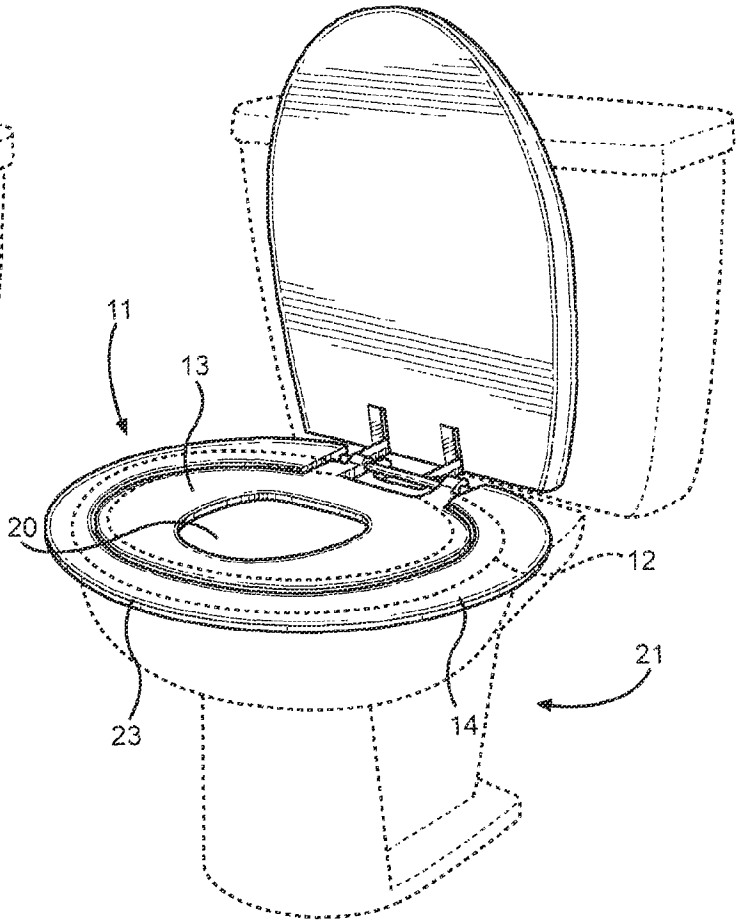
FIG. 2 shows a perspective view of the present invention, with the toilet seats in a use position, and the lid in an up position.

Reference is made herein to the attached drawings. Like reference numerals are used throughout the drawings to depict like or similar elements of the toilet seat. For the purposes of presenting a brief and clear description of the present invention, the preferred embodiment will be discussed as used for attaching to a conventional toilet, and providing a sitting area for average sized adults, small children, and larger adults. The figures are intended for representative purposes only and should not be considered to be limiting in any respect.

Figure 1:
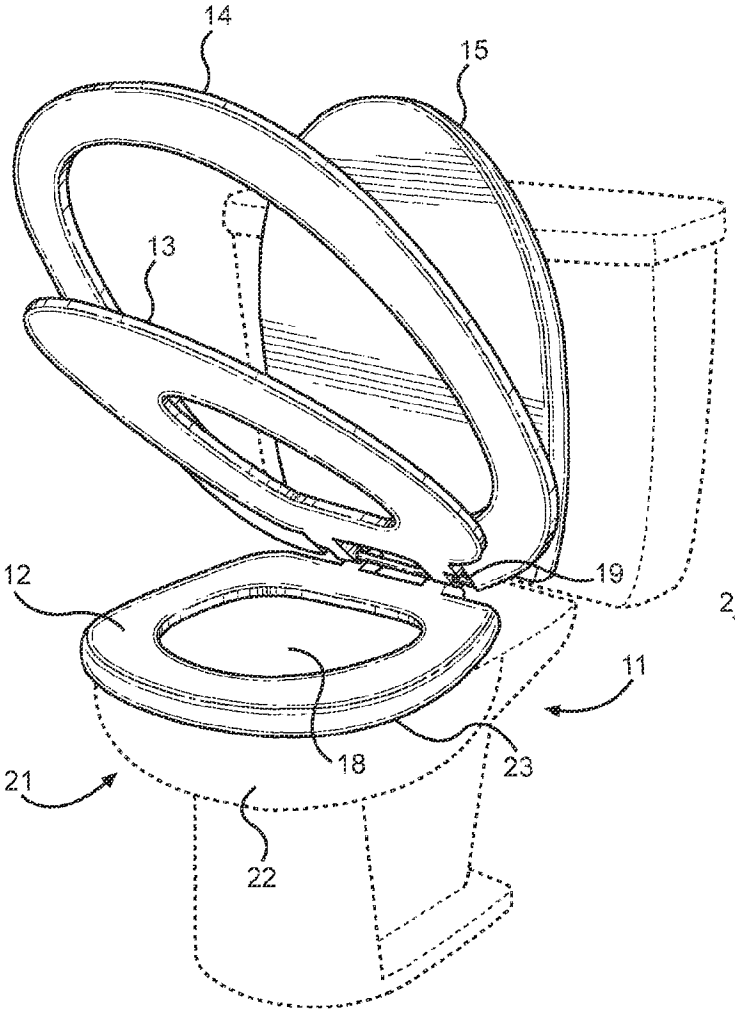
FIG. 1 shows a perspective view of the present invention with a first seat in the use position, and the second and third seats in an up position.

Referring now to FIG. 1, there is shown a perspective view of the present invention, which comprises a toilet seat assembly 11 designed to fit on a conventional toilet 21. The toilet seat assembly 11 includes a primary seat 12 that is designed to resemble a standard sized toilet seat, which rests on top of a conventional toilet bowl 22. A first auxiliary seat 13 is sized for smaller individuals, and can be pivotally placed on top of the primary seat 12. The first auxiliary seat 13 can be used by individuals who have difficulty fitting on a conventional toilet seat due to their smaller size. The device further includes a secondary auxiliary seat 14 that can be placed on the outside of the primary and first auxiliary seats 12, 13. The second auxiliary seat 14 is a larger seat that can be used for large adults. The first and second auxiliary seats 13, 14 can be attached to the primary seat 12 with a hinge 19 in the back of the seat. The hinge 19 permits each seat 12, 13, and 14 to be raised and lowered in a manner similar to a conventional toilet seat. The primary seat 12 can be pivotally placed in a down or use position, with the first and second auxiliary seat 13, 14 in the up position. The first auxiliary seat 13 can be pivotally placed in a use position, wherein the first auxiliary seat 13 rests on top of the primary seat 12, thereby creating a smaller opening for children. In addition, the second auxiliary seat 14 can be pivotally placed in a use position on top of the primary and first auxiliary seat 12, 13 for use by larger individuals.

Also attached to the device is a lid 15 that can be pivotally placed in a closed position when the toilet 21 is not in use.

The primary seat 12 of the present invention resembles a conventional toilet seat, and is designed to rest on the rim 23 of a conventional toilet 21. The primary seat 12 contains a sitting area, which supports the weight of a user when sitting thereon. The seat 12 further includes an aperture 18 in the center thereof that allows access to the interior of the toilet bowl 22. The primary seat 12 is attached to a hinge mount 31 that permits the primary seat 12 to be raised and lowered. The primary seat 12 can be used independently of the first and second auxiliary seats 13, 14, whereby the primary seat 12 is placed in a use position on the rim 23 of the toilet 21, with the first and second auxiliary seats 13, 14 in an up position.

The first auxiliary seat 13 is designed to fit over top of the primary seat 12. The first auxiliary seat 13 includes a sitting area that rests on top of the primary seat 12. The aperture 18 of the first auxiliary seat 13 is smaller than that of the primary seat 12. This enables users of smaller size, such as small children, to securely sit thereon. When small children sit on and use a conventional sized toilet seat, their buttocks is smaller than the aperture in the toilet, meaning that the seat provides no support thereto. Children must balance on the seat with their arms supporting their weight, as to not fall into the toilet bowl 22. This can be too difficult for many children, meaning that an alternate solution must be found. The smaller aperture 20 of the first auxiliary seat 13 enables the seat to support the buttocks of the child, meaning that no support is required by the arms of the user.

Similar to the first auxiliary seat 13, the second auxiliary seat 14 is designed to fit over top of the primary seat 12. The second auxiliary seat 13 includes a sitting area that rests on top of the primary seat 12. The sitting area for the second auxiliary seat 14 extends beyond the primary seat 12, and provides an enlarged sitting area for users of larger size. This affords additional stability to a larger user, whose buttocks may extend beyond the sitting area of a conventional sized toilet seat.

Referring now to FIG. 2, there is shown a perspective view of the present invention, with the toilet seats 12, 13, and 14 in a use position, and the lid in an up position. The seats 12, 13, and 14 of the present invention are capable of being raised and lowered independently, thereby allowing a user to select an appropriately sized seat. The primary seat 12 is designed to resemble a conventional toilet seat that is well known in the art, and securely rests on top of the toilet rim 23.

The first auxiliary seat 13 comprises a child's seat, with a smaller aperture 20 to prevent the child from falling into the opening in the toilet 21. The first auxiliary seat 13 fits over top of the primary seat 12 such that the sitting area of primary seat 12 extends beyond the first auxiliary seat 13, providing support thereto when the first auxiliary seat 13 is in a use position. The smaller size of the aperture 20 in the first auxiliary seat 13 is accomplished by enlarging the sitting area. This provides a safer sitting area for a child, and further prevents the child from wetting the primary seat 12. If a child inadvertently wets the first auxiliary seat 13, the extended size of the sitting area will prevent the liquid from making contact with the primary seat 12, such that the liquid will drop directly down into the toilet 21.

The second auxiliary seat 14 can also be positioned to rest on top of the primary seat 12. As previously described, the smaller size of the first auxiliary seat 13 permits the primary seat 12 to extend beyond the first auxiliary seat 13. This provides a rim for the second auxiliary seat 14 to be supported by. When the first and second auxiliary seats 13, 14 are in a use position, they are both supported by the primary seat 12. The first auxiliary seat 13 is supported by the interior portion of the primary seat 12, while the second auxiliary seat 14 is supported by the outer portion of the primary seat 12. The design provides a sufficient amount of contact area between the primary seat 12 and second auxiliary seat 14. This enables the second auxiliary seat 14 to extend beyond the primary seat 12 and the rim 23 of the toilet, thereby providing an enlarged sitting area for a large adult.

The second auxiliary seat 14 can be used with the first primary seat 12 in a use position, or in the up position. When in the use position, the first auxiliary seat 13 nests inside of the second auxiliary seat 14, which gives a user additional width for sitting. This configuration allows for additional support by distributing the user's weight over a larger sitting area. Alternately, a user can place the first auxiliary seat 13 in the up position, whereby the first auxiliary seat 13 is moved into a vertical position with the lid 15. In this configuration, the weight of the user is supported entirely by the second auxiliary seat 14. When the first auxiliary seat 13 is moved into the up position, the aperture 20 is of larger size, which provides greater access to the toilet bowl.

Figure 3:
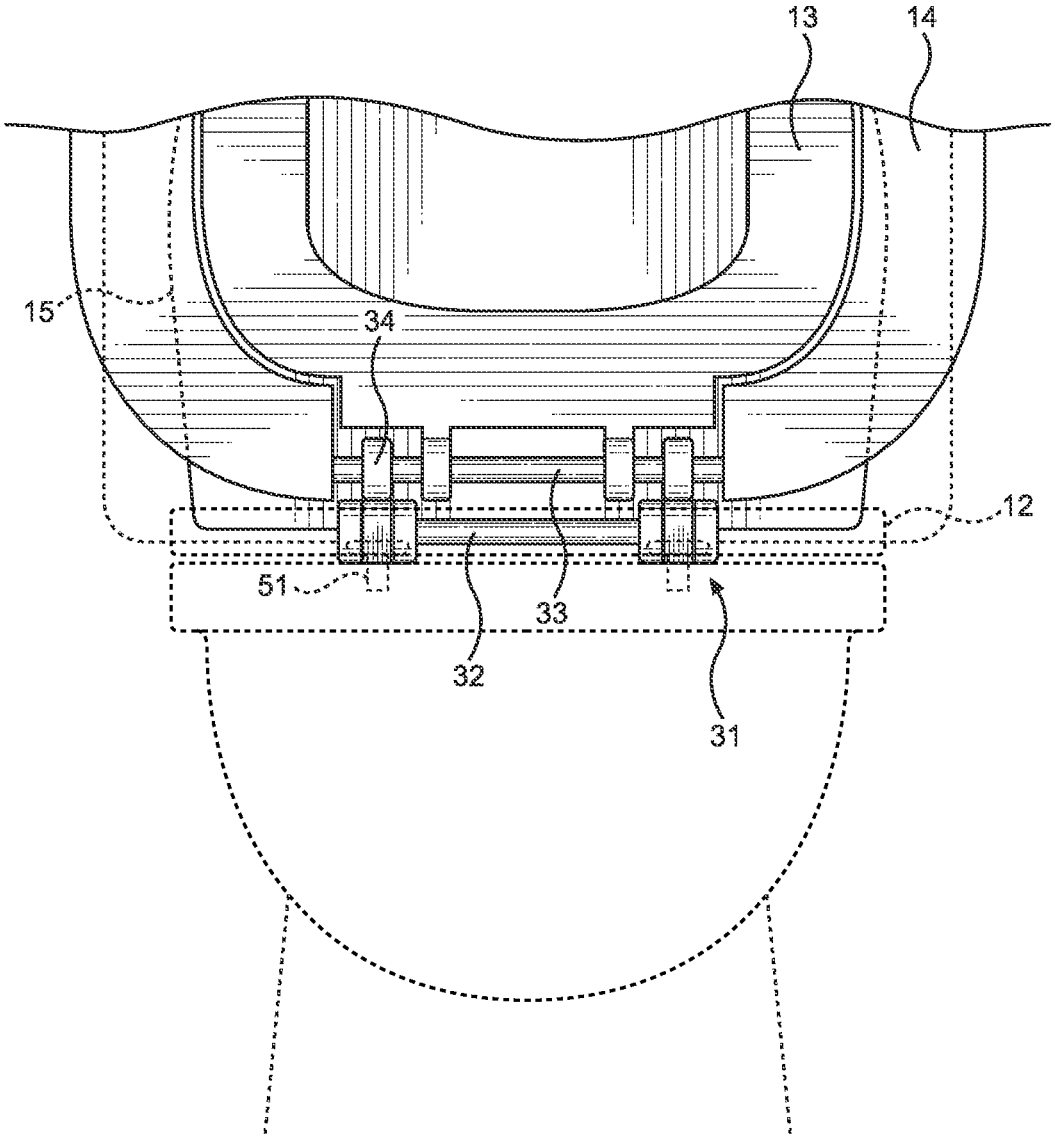
FIG. 3 shows a close-up view of the hinge mount.

Referring now to FIG. 3, there is shown a close-up view of the hinge mount 31. The device includes a mounting means that allows for independent movement of the primary seat 12, first and second auxiliary seats 13, 14, and lid 15. The hinge mount 31 attaches to the toilet bowl with a conventional bolt fastener 51 that is well understood in the art. The primary seat 12 includes a primary hinge 32 that functions in a manner similar to a conventional toilet seat hinge. This enables the primary seat 12 to be raised and lowered as needed. The lid 15 is also attached to the primary hinge 32, which allows for raising and lowering thereof.

Attached above the primary hinge 32 is a secondary hinge 33 that allows for movement of the first and second auxiliary seats 13, 14. The first auxiliary seat 13 attaches on the inside of the hinge 32, while the secondary auxiliary seat 14 attaches on the outside of the primary hinge 32. This allows both seats 13, 14 to attach to the primary hinge 32 in a manner that permits both seats 13, 14 to rest flush on the top of the primary seat 12, thereby creating an enlarged sitting area for a large individual. This design further allows for independent raising and lowering of each seat 13, 14. The first auxiliary seat 13 can rotate about the primary hinge 32 independent of the secondary seat 14. In a similar manner, the second auxiliary seat 14 can rotate independent of the first auxiliary seat 13.

In operation, the primary, first and second auxiliary seats 12, 13, and 14, and the lid 15 can be placed in a down position. A user may lift the lid 15, which is attached to the primary hinge 32, while the primary and first and second auxiliary seats 12, 13, and 14 are in the down or use position. The first and second auxiliary seats 13, 14, which are attached to the secondary hinge 33, may be independently raised as required by the user. Once the lid 15 and secondary seats 13, 14 are raised, the primary seat 12, which is attached to the primary hinge 32 can be raised and lowered as required.

In the preferred embodiment, the first and second auxiliary seats 13, 14 attach to the primary hinge 32 with a clip 34. The clip 34 permits attachment and detachment of the first and second auxiliary seats 13, 14, thereby allowing for use of the primary seat 12 only. A user can detach each seat 13, 14 as required, which is particularly useful after a small child has learned to use a conventional toilet seat. In an alternate embodiment, the seats 13, 14 can be permanently attached to the secondary hinge 33.

Overall, the device provides a user with a toilet seat that can be used by individuals of varying size. The primary seat can be used by individuals of average size in a conventional manner. The first auxiliary seat can be used by children or other small individuals who find it difficult to balance on a standard size toilet. The second auxiliary seat can then be used by individuals of larger size, thereby preventing the user from finding the size of the toilet seat to be too small to properly balance on. Each seat can be independently raised and lowered as needed. The device can be installed on a conventional toilet, requires no maintenance, and provides a seat that can accommodate a wider variety of individuals.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet seat assembly, comprising:

a primary seat comprising a first opening;

a first auxiliary seat comprising a second opening;

a second auxiliary seat comprising a third opening, the third opening being a through-hole;

wherein the second opening is smaller than the first opening and the third opening is larger than wherein the third opening is sized to receive the first auxiliary seat therethrough;

wherein the first auxiliary seat rests against an inner portion of the primary seat when in a lowered position, the second auxiliary seat rests against an outer portion of the primary seat when in a lowered position, and the first auxiliary seat rests embedded and flush with the second auxiliary seat when in the lower positions;

a mount adapted to attach the toilet seat assembly to a toilet;

wherein the primary seat, the first auxiliary seat, and the second auxiliary seat are pivotally attached to the mount.

2. The toilet seat assembly of claim 1, wherein the primary seat, the first auxiliary seat, and the second auxiliary seat are independently pivotable.

3. The toilet seat assembly of claim 1, further comprising a lid pivotally attached to the mount.

4. The toilet seat assembly of claim 3, wherein the primary seat, the first auxiliary seat, the second auxiliary seat, and the lid are independently pivotable.

5. The toilet seat assembly of claim 1, wherein the first opening, the second opening, and the third opening are concentric.

6. The toilet seat assembly of claim 1, wherein the primary seat is adapted to rest against a rim of a toilet bowl when in a lowered position.

7. The toilet seat assembly of claim 1, wherein the first auxiliary seat and the second auxiliary seat are adapted to rest against the primary seat when in a lowered position.

8. The toilet seat assembly of claim 1, wherein the second auxiliary seat is sized to provide a sitting area extending beyond the primary seat.

9. The toilet seat assembly of claim 1, wherein the first auxiliary seat is sized to provide a sitting area smaller than the primary seat.

10. The toilet seat assembly of claim 1, wherein the mount is affixed to the toilet via a fastener.

11. The toilet seat assembly of claim 1, wherein the first auxiliary seat and the second auxiliary seat are removably attached to a hinge of the mount.

12. The toilet seat assembly of claim 11, wherein the first auxiliary seat and the second auxiliary seat are attached to the hinge via a clip.

13. The toilet seat assembly of claim 1, wherein the first auxiliary seat and the second auxiliary seat are integrally attached to a hinge of the mount.

14. The toilet seat assembly of claim 1, further comprising:

a first hinge to which the primary seat is pivotally connected;

a second hinge to which the first auxiliary seat and the second auxiliary seat are pivotally connected.

15. The toilet seat assembly of claim 1, further comprising:

a lid;

a first hinge to which the primary seat and the lid are pivotally connected;

a second hinge to which the first auxiliary seat and the second auxiliary seat are pivotally connected.

* * * * *